US008737905B2

(12) United States Patent
Yamamoto

(10) Patent No.: US 8,737,905 B2
(45) Date of Patent: May 27, 2014

(54) IMAGE FORMING APPARATUS AND DRIVER

(75) Inventor: Hiroyuki Yamamoto, Kasugai (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 449 days.

(21) Appl. No.: 12/731,246

(22) Filed: Mar. 25, 2010

(65) Prior Publication Data

US 2010/0303528 A1 Dec. 2, 2010

(30) Foreign Application Priority Data

May 27, 2009 (JP) ..... 2009-128132

(51) Int. Cl.
*G03G 15/00* (2006.01)
*B65H 85/00* (2006.01)

(52) U.S. Cl.
USPC ..... 399/401

(58) Field of Classification Search
USPC ..... 399/401
See application file for complete search history.

(56) References Cited

U.S. PATENT DOCUMENTS

| | | | | | |
|---|---|---|---|---|---|
| 5,257,035 | A * | 10/1993 | Funahashi et al. | ..... | 347/139 |
| 5,987,300 | A * | 11/1999 | Mori | ..... | 399/401 |
| 6,353,717 | B1 | 3/2002 | Suzuki | | |
| 2002/0001098 | A1 | 1/2002 | Moriyama et al. | | |
| 2002/0054303 | A1* | 5/2002 | Matsuyama | ..... | 358/1.2 |
| 2008/0201594 | A1 | 8/2008 | Narushima | | |
| 2008/0266599 | A1* | 10/2008 | Suzuki | ..... | 358/1.15 |

FOREIGN PATENT DOCUMENTS

| | | | | | |
|---|---|---|---|---|---|
| JP | 03067674 | A * | 3/1991 | ..... | G03G 15/00 |
| JP | 6-24050 | A | 2/1994 | | |
| JP | 06169368 | A * | 6/1994 | ..... | B65H 85/00 |
| JP | 8-52907 | A | 2/1996 | | |
| JP | 8-328320 | | 12/1996 | | |
| JP | 9-298620 | | 11/1997 | | |
| JP | 9-330186 | | 12/1997 | | |
| JP | 11-70700 | | 3/1999 | | |
| JP | 11-133678 | | 5/1999 | | |
| JP | 11-133833 | | 5/1999 | | |
| JP | 11-160919 | A | 6/1999 | | |
| JP | 11-184658 | | 7/1999 | | |
| JP | 1 1-284818 | A | 10/1999 | | |

(Continued)

OTHER PUBLICATIONS

Japanese Official Action dated Apr. 26, 2011 together with an English language translation from JP 2009-128132.

(Continued)

*Primary Examiner* — Nguyen Ha
(74) *Attorney, Agent, or Firm* — Scully, Scott, Murphy & Presser, P.C.

(57) ABSTRACT

An image forming apparatus and a driver for the image forming apparatus are provided. The image forming apparatus includes: a first communication section configured to receive print data; a printing section configured to perform a duplex printing including printing N sheets on first sides thereof and subsequently printing M sheets on second sides thereof, wherein M is equal to or smaller than N; a setting section configured to set the value of N; and a control section configured to control the printing section to perform the duplex printing in accordance with the value of N set by the setting section. The value of N may be set based on a communication speed of the print data when acquired by the acquisition section.

8 Claims, 11 Drawing Sheets

(56) References Cited

FOREIGN PATENT DOCUMENTS

| | | | | | |
|---|---|---|---|---|---|
| JP | 2000-71570 | | | 3/2000 | |
| JP | 2000-94803 | A | | 4/2000 | |
| JP | 2000-255143 | | | 9/2000 | |
| JP | 2000-338826 | | | 12/2000 | |
| JP | 2001-134142 | | | 5/2001 | |
| JP | 2002-196064 | | | 7/2002 | |
| JP | 2003-11473 | | | 1/2003 | |
| JP | 2003011473 | A | * | 1/2003 | ..... G03G 15/00 |
| JP | 2004-272021 | A | | 9/2004 | |
| JP | 2004-347627 | A | | 12/2004 | |
| JP | 2005-181465 | | | 7/2005 | |
| JP | 2007-30476 | A | | 2/2007 | |
| JP | 2008-64943 | | | 3/2008 | |
| JP | 2008-204209 | | | 9/2008 | |
| JP | 2008-276531 | | | 11/2008 | |
| JP | 2009086398 | A | * | 4/2009 | ..... G03G 21/14 |
| JP | 2009-113249 | | | 5/2009 | |

OTHER PUBLICATIONS

Chinese Official Action dated Oct. 26, 2012 from related application CN 201010148883.2 together with an English language translation.

Chinese Office Action dated Apr. 28, 2012 from related Chinese Application No. 201010148883.2 together with an English language translation.

* cited by examiner

IMAGE FORMING APPARATUS AND DRIVER

CROSS-REFERENCE TO RELATED APPLICATION

This application claims priority from Japanese Patent Application No. 2009-128132, filed on May 27, 2009, the entire subject matter of which is incorporated herein by reference.

TECHNICAL FIELD

Aspects of the present invention relate to an image forming apparatus capable of duplex printing and a driver for the image forming apparatus, and more particularly, to an image forming apparatus capable of duplex printing by printing a plurality of sheets on first sides thereof and subsequently printing the sheets on second sides thereof, and a driver therefor.

BACKGROUND

There has been proposed a technique for improving a speed of the duplex printing process by printing N sheets (N is a positive integer) on the first sides thereof and subsequently printing M sheets (M is an integer equal to or more than 0 and equal to or less than N) on the second sides thereof. For example, for performing the duplex printing on 10 pages (5 sheets), an image forming apparatus prints them in the page order of 2 (even page), 4 (even page), 1 (odd page), 6 (even page), 3 (odd page), 8 (even page), 5 (odd page), 10 (even page), 7 (odd page) and 9 (odd page). Furthermore, an image forming apparatus prints them in the page order of 1, 3, 5, 2, 7, 4, 9, 6, 8, and 10.

However, in the above-mentioned duplex printing technique, there have been the following problems. That is, if the communication speed of the print data is not sufficiently high, a time required for the image fanning apparatus to receive print data for "one printing process unit" (for example, one page) and completing printing preparation may become longer than a time required for a printing operation of the "one printing process unit". In this case, even though a printing speed is increased by increasing the number of sheets to be successively printed on first sides thereof, the printing preparation for starting the printing operation of subsequent "one printing process unit" may not be completed before a certain printing operation of "one printing process unit" is completed. Therefore, the printing operation may be temporarily suspended. In that case, the advantage of printing successively on first sides can be not fully enjoyed. Additionally, as the plurality of sheets are printed on the first sides thereof, the number of sheets staying in the image forming apparatus increases. Therefore, there may be a disadvantage in that the number of defective print sheets increases, which are caused by a sheet jam.

SUMMARY

Accordingly, it is an aspect of the present invention to provide an image forming apparatus capable of efficiently performing the duplex printing while reducing a possibility of the temporary suspension of the printing operation and to provide a driver for the image forming apparatus.

According to an illustrative embodiment of the present invention, there is provided an image forming apparatus comprising: an acquisition section configured to acquire print data; a printing section configured to perform a duplex printing including printing N sheets on first sides thereof and subsequently printing M sheets on second sides thereof, wherein M is equal to or smaller than N; a determination section configured to determine the value of N, wherein the determination section determines a smaller value as the value of N, as a communication speed of the print data when acquired by the acquisition section is lower; and a control section configured to control the printing section to perform the duplex printing in accordance with the value of N determined by the determination section.

According to another illustrative embodiment of the present invention, there is provided a computer readable medium having a driver stored thereon and readable by a computer, the driver being used for an image forming apparatus configured to perform a duplex printing including printing N sheets on first sides thereof and subsequently printing M sheets on second sides thereof, wherein M is equal to or smaller than N, the driver, when executed by the computer, causing the computer to perform operations comprising: transmitting print data to the image forming apparatus; determining the value of N, wherein a smaller value is determined as the value of N, as a transmission speed of the print data is lower; and transmitting a print job of duplex printing including information indicating the determined value of N, to the image forming apparatus.

According to another illustrative embodiment of the present invention, there is provided an image forming apparatus comprising: a first communication section configured to receive print data; a printing section configured to perform a duplex printing including printing N sheets on first sides thereof and subsequently printing M sheets on second sides thereof, wherein M is equal to or smaller than N; a setting section configured to set the value of N; and a control section configured to control the printing section to perform the duplex printing in accordance with the value of N set by the setting section.

According to illustrative embodiments, it is possible to provide an image forming apparatus, which is capable to efficiently perform the duplex printing while reducing the possibility of the temporary suspension of the printing operation, and the driver for the image forming apparatus.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Hereinafter, an image forming apparatus according to an illustrative embodiment of the present invention will be described in detail with reference to the accompanying drawings. In the illustrative embodiment, there will be described an electrophotographic color printer as an example of the image forming apparatus. The color printer is capable of duplex printing by printing a plurality of sheets on the first sides thereof and subsequently printing the sheets on the second sides thereof.

[Overall Configuration of Printer]

Figure 1:
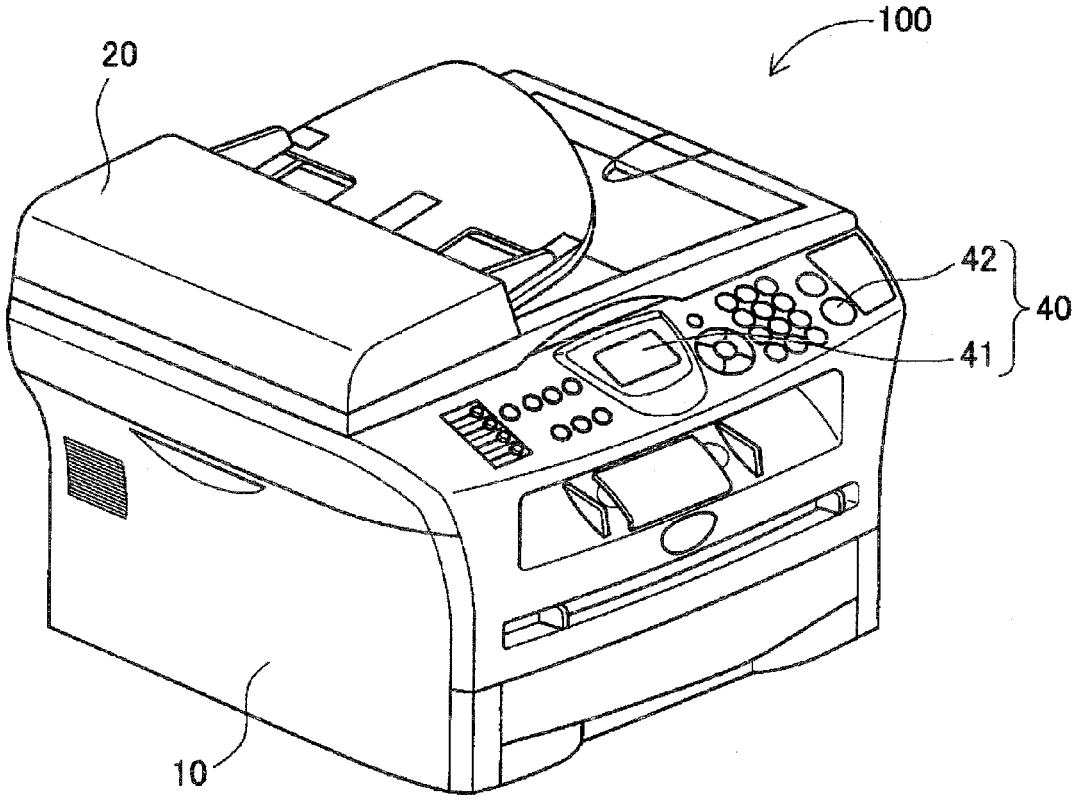
FIG. 1 is a perspective view illustrating a schematic configuration of a printer according to an illustrative embodiment.

As shown in FIG. 1, a printer 100 according to an illustrative embodiment includes an image forming section 10 that forms an image on a sheet and an image reading section 20 that reads an image of an original document. On the front side of the image reading section 20, there is provided an operation panel 40 including a display section 41 that is configured as a liquid crystal display, and a button group 42 that includes a start key, a stop key, a numeric keypad, and the like. The operation panel 40 is configured to display an operation status of the printer 100 and allow a user to perform an input operation.

[Configuration of Image Forming Section of Printer]

Figure 2:
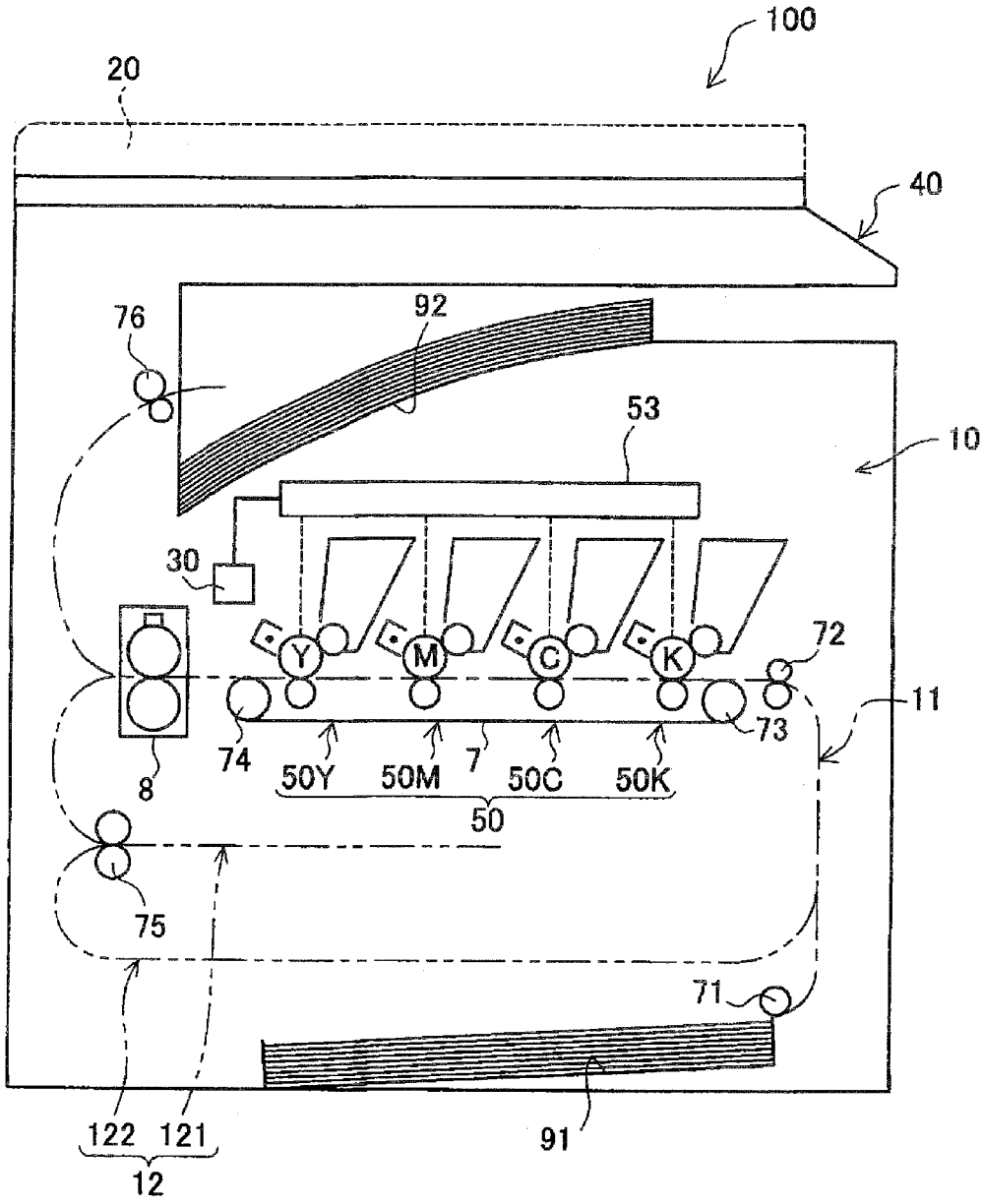
FIG. 2 is a conceptual diagram illustrating an internal configuration of an image forming section of the printer shown in FIG. 1.

As shown in FIG. 2, the image forming section 10 includes a processing section 50 that forms a toner image and transfers the toner image on a sheet, a fixing unit 8 that fixes the unfixed toner on the sheet, a sheet feeding cassette 91 that accommodates sheets on which an image has not been formed yet, and a sheet discharging tray 92 that receives sheets on which an image has been formed. Further, in the image forming section 10, a substantially S-shaped conveying path 11 (the chain line shown in FIG. 2) is provided. Along the conveying path 11, a sheet accommodated in the sheet feeding cassette 91 which is located on the bottom portion of the image forming section 10 is passed through a sheet feeding roller 71, the processing section 50, and the fixing unit 8, and is discharged by a sheet discharging roller 76 to the sheet discharging tray 92 which is located on the upper portion of the image forming section 10.

The processing section 50 is capable of forming a color image, and includes four processing units corresponding to the respective colors of yellow (Y), magenta (M), cyan (C), and black (K) which are arranged in parallel. Specifically, the processing section 50 includes a processing unit 50Y that forms a yellow (Y) image, a processing unit 50M that forms a magenta (M) image, a processing unit 50C that forms a cyan (C) image, and a processing unit 50K that forms a black (K) image. The processing section 50 further includes an exposure unit 53 that illuminates light on the respective processing units 50Y, 50M, 50C, and 50K, and a conveying belt 7 that is looped between the rollers 73 and 74 and that conveys a sheet to the transfer positions of the respective processing units 50Y, 50M, 50C, and 50K. Each of the processing units 50K, 50Y, 50M, and 50C is configured to form a toner image by an electrophotographic method.

The image forming section 10 feeds the sheets accommodated on the sheet feeding cassette 91 one by one, conveys the fed sheet to the processing section 50, and transfers the toner images formed by the processing section 50 onto the sheet. Furthermore, the sheet onto which the toner images are transferred is conveyed into the fixing unit 8, and the toner images are thermally fixed on the sheet. Then, the fixed sheet is discharged to the sheet discharging tray 92.

Furthermore, the image forming section 10 has a duplex printing mechanism that prints both sides (first side and second side) of a sheet. As shown in FIG. 2, a conveying path 12 (the chain double-dashed line in FIG. 2) is used for reversing the sheet and conveying the sheet again to the processing section 50 so as to perform printing on the back side (the second side) of the sheet printed on one side (the first side). The conveying path 12 branches from the conveying path 11 at a position at a downstream side from the fixing unit 8 in a sheet conveying direction. The conveying path 12 includes a conveying path 121 (hereinafter referred to as a "temporary staying path 121") for temporarily allowing the sheet to stay in order to reverse the sheet conveying direction and a conveying path 122 (hereinafter referred to as a "returning path 122") for returning the reversed sheet to the conveying path 11.

Specifically, in the duplex printing performed by the image forming section 10, the sheet is reversed in the following procedure. First, the sheet which is passed through the conveying path 11 (hereinafter referred to as a "forward conveying path 11") and has an image formed on the first side thereof, is thermally fixed by the fixing unit 8, and is subsequently sent to the conveying path 12 (hereinafter referred to as a "reverse conveying path 12"). Then, the sheet is conveyed into the temporary staying path 121, and the conveyance of the sheet is temporarily suspended. Thereafter, by turning the rotation direction of the turning roller 75, the sheet conveying direction is reversed, and the sheet is conveyed into the returning path 122. Then, the sheet is returned to the forward conveying path 11 at an upstream side from the processing section 50. Accordingly, the sheet is reversed, and an image is formed on the second side.

The image forming section 10 has a function of successively printing N sheets (N is a positive integer) on the first sides thereof and subsequently printing M sheets (M is an integer equal to or more than 0 and equal to or less than N) on the second sides thereof at the time of performing the duplex printing. Furthermore, the image forming section 10 has a function of changing the number of sheets N and the number of sheets M to be successively printed. The change of N and M is performed by adjusting the timing of sheet conveyance and the conveying speed. The number of sheets N to be successively printed is appropriately set by the printing process (the procedure of determining N in S103) to be described later.

Figure 3:
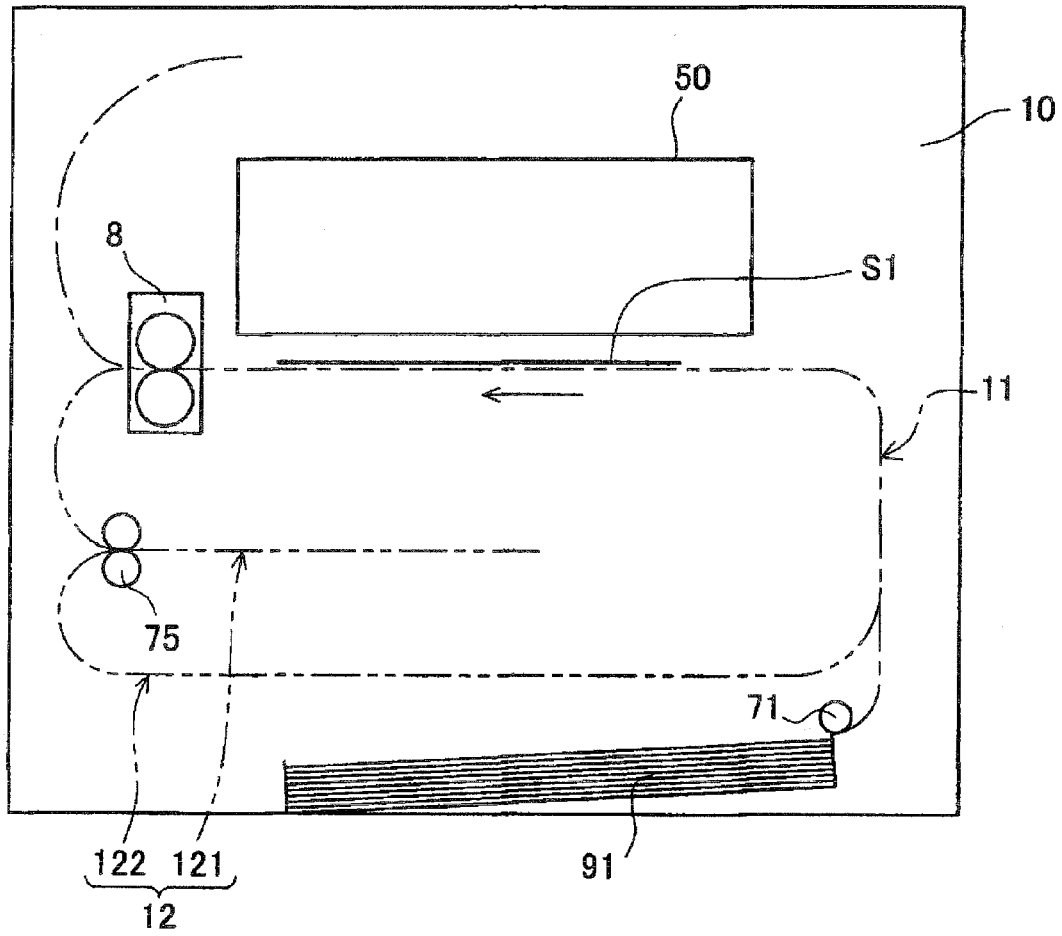
FIG. 3 is a first diagram illustrating a sheet conveying procedure of the duplex printing for the case where the number of sheets to be successively printed on the first sides is 2.
Figure 4:
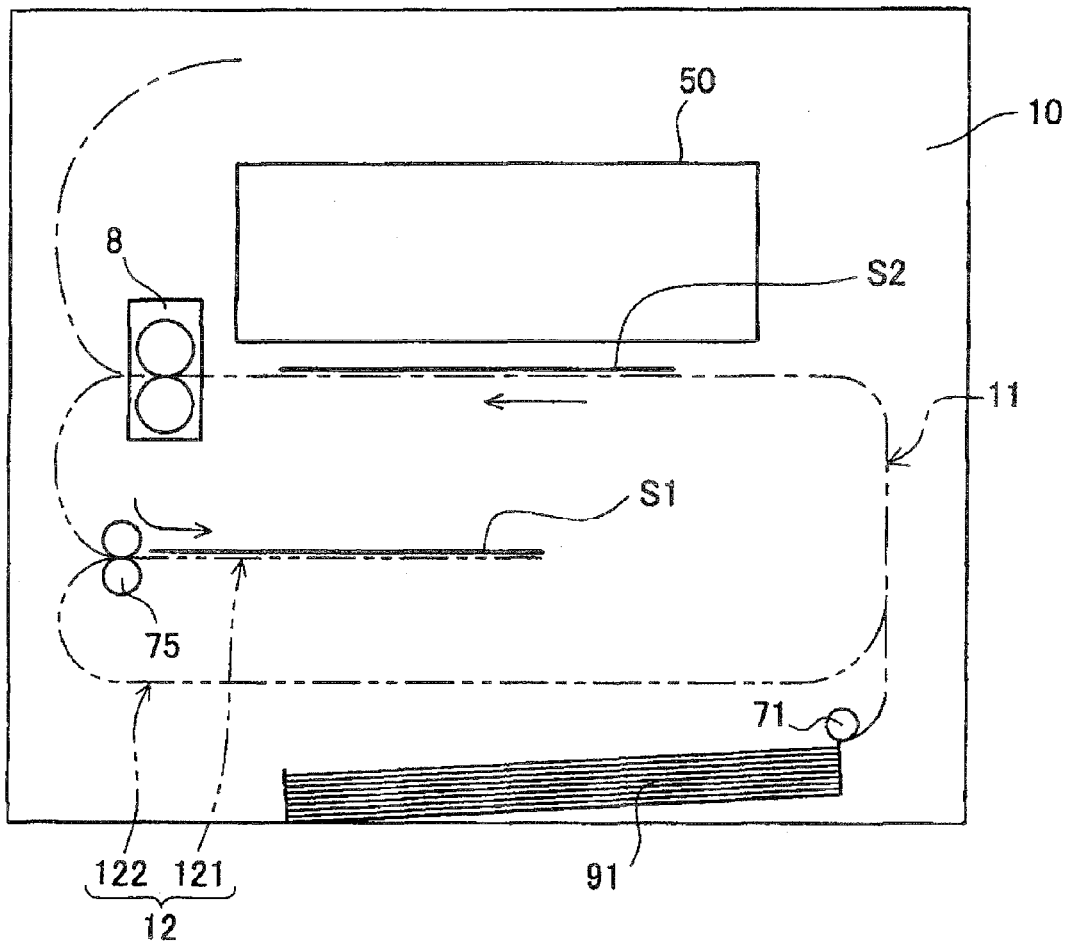
FIG. 4 is a second diagram illustrating the sheet conveying procedure of the duplex printing for the case where the number of sheets to be successively printed on the first sides is 2.

For example, when the number of sheets N to be successively printed is 2, the sheets are conveyed in the following procedure. First, as shown in FIG. 3, the first sheet S1 is conveyed into the forward conveying path 11, and is printed on the first side thereof by the processing section 50 (step 1). Next, as shown in FIG. 4, while the sheet S1 is conveyed into the reverse conveying path 12, the second sheet S2 is conveyed into the forward conveying path 11, and is printed on the first side thereof by the processing section 50 (step 2). Then, while the sheet S2 is conveyed into the reverse conveying path 12, the sheet S1 is returned to the forward conveying path 11, and is printed on the second side thereof by the processing section 50 (step 3). Subsequently, while the sheet S1 is discharged to the sheet discharging tray 92, the sheet S2 is returned to the forward conveying path 11, and is printed on the second side thereof by the processing section 50 (step 4). Consequently, the printing is performed in order of the first side of the first sheet, the first side of the second sheet, the second side of the first sheet, and the second side of the second sheet. In this procedure, during the reversing of a sheet (the first sheet), the printing is performed on another sheet (the second sheet). Accordingly, since printing of the second sheet is performed while waiting for the reversing of the first sheet, the standby time of the processing section 50 becomes shorter as compared with the case where the printing is performed on a sheet in order of the first side and second side on a sheet-by-sheet basis, so that printing efficiency can be improved.

Figure 5:
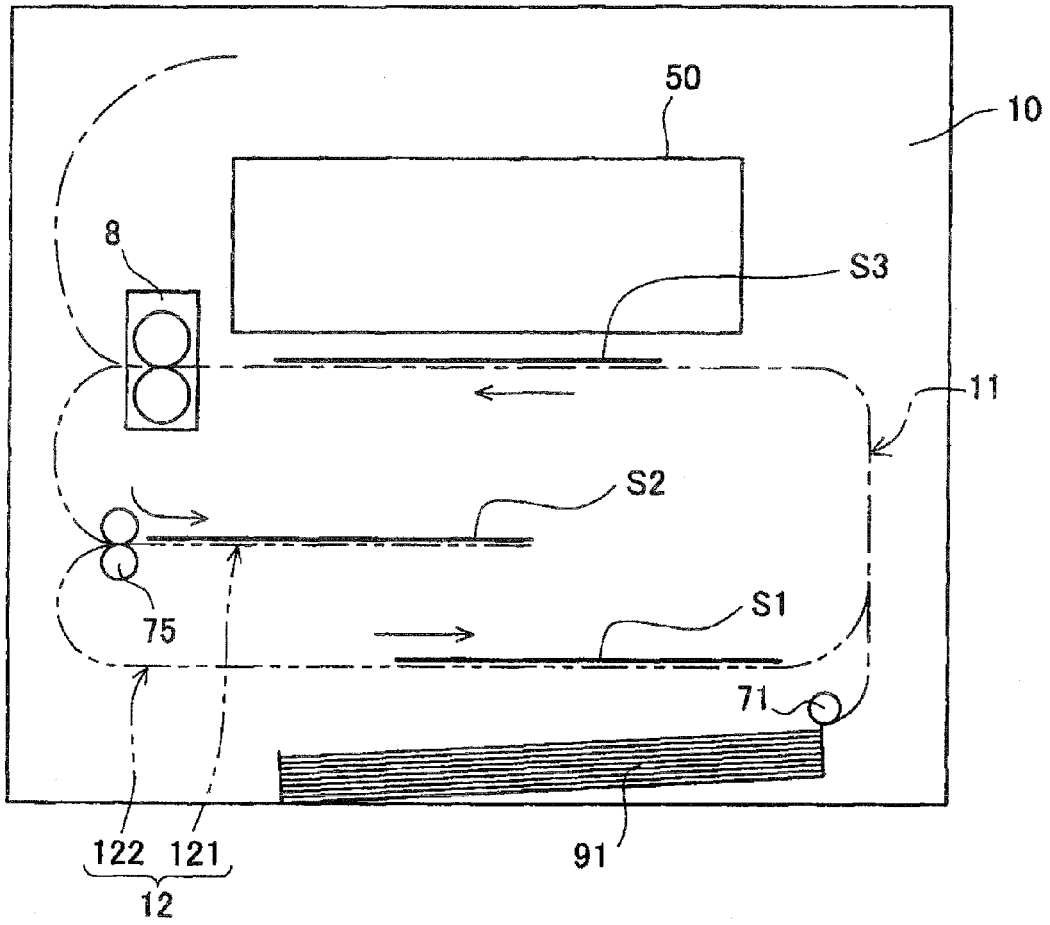
FIG. 5 is a diagram illustrating a sheet conveying procedure of the duplex printing for the case where the number of sheets to be successively printed on the first sides is 3.

Further, for example, when the number of sheets N to be successively printed is 3, the sheets are conveyed in the following procedure. First, the first sheet S1 is conveyed into the forward conveying path 11, and is printed on the first side thereof. Next, while the sheet S1 is conveyed into the temporary staying path 121, the second sheet S2 is conveyed into the forward conveying path 11, and is printed on the first side thereof. Subsequently, as shown in FIG. 5, the sheet S1 is conveyed into the returning path 122, the sheet S2 is conveyed into the temporary staying path 121, and the third sheet S3 is conveyed into the forward conveying path 11. Then, the sheet S3 is printed on the first side thereof. In this step, the sheet S1 is caused to stay in the reverse conveying path 12 (being conveyed in the reverse conveying path 12), and is not returned to the forward conveying path 11. That is, two sheets are staying in the reverse conveying path 12. Thereafter, in order of the sheets S1, S2, and S3, the sheets are returned to the forward conveying path 11, and are printed on the second sides thereof. Consequently, the printing is performed in order of the first side of the first sheet, the first side of the second sheet, the first side of the third sheet, the second side of the first sheet, the second side of the second sheet, and the second side of the third sheet. This conveying order allows the standby time of the processing section 50 to be further shorter as compared with the case where the number of sheets N to be successively printed is 2, so that printing efficiency can be improved further.

It is noted that the maximum number of sheets N to be successively printed is different depending on the number of sheets capable of staying in the reverse conveying path 12. The number of sheets capable of staying in the reverse conveying path 12 depends on the length of the reverse conveying path 12, the length of the sheet in the sheet conveying direction, and the like. That is, the number of sheets N to be successively printed is not limited to 2 or 3 described above, but may be 4 or more.

[Electric Configuration of Printer]

Figure 6:
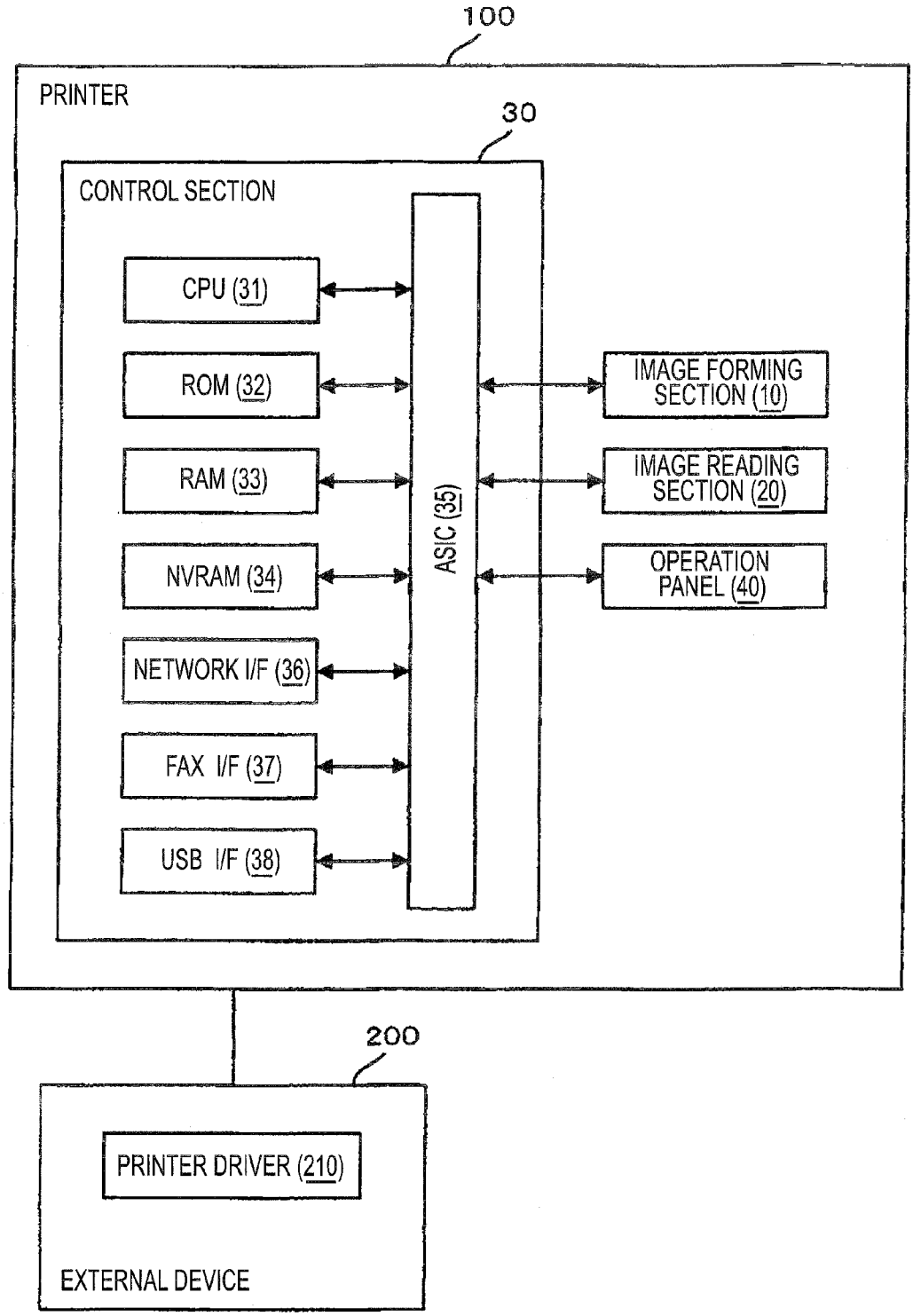
FIG. 6 is a block diagram illustrating an electric configuration of the printer.

Subsequently, an electric configuration of the printer 100 will be described. As shown in FIG. 6, the printer 100 includes a control section 30. The control section 30 includes a Central Processing Unit (CPU) 31, a Read Only Memory (ROM) 32, a Random Access Memory (RAM) 33, a nonvolatile RAM (NVRAM) 34, an Application Specific Integrated Circuit (ASIC) 35, a network interface 36, a FAX interface 37, and a USB interface 38. Furthermore, the control section 30 is electrically connected to the image forming section 10, the image reading section 20, and the operation panel 40.

The ROM 32 stores various control programs and various settings for controlling the printer 100, initial values, and the like. The RAM 33 is used as a work area, from which the various control programs are read, or as a storage area which temporarily stores image data.

The CPU 31 stores the processing result in the RAM 33 or the NVRAM 34 according to signals transmitted from various sensors and the control program read from the ROM 32, and controls various elements of the printer 100 through the ASIC 35 (for example, lighting timing of the exposure device 53, drive motors (not shown) of the various rollers constituting the forward conveying path 11 and the reverse conveying path 12, and moving motors (not shown) of an image sensor unit constituting the image reading section 20).

The network interface 36 is connected to a network such as the interne to enable a network communication such as Ethernet (registered trademark). The FAX interface 37 is connected to a public line to enable a FAX communication. The USB interface 38 enables direct data communication with other apparatuses. A print job can be communicated through the network interface 36, the FAX interface 37, or the USB interface 38.

The printer 100 is connected through various communication interfaces to an external device 200 such as a personal computer (PC) in which a printer driver 210 for the printer 100 is installed. The external device 200 connected to the printer 100 is not limited to the PC or a FAX device, and the printer 100 may be connected to another external device.

[Printing Process]

Subsequently, the printing process in the printer 100 will be described with reference to the flowchart of FIG. 7. The printer 100 performs the printing process in response to a reception of a print job transmitted (communicated) from the external device 200.

First, acquisition of the print data starts (S101). That is, the printer 100 receives the print data corresponding to pages sequentially, and acquires print-job-attribute information including information on a duplex printing setting.

Next, it is determined whether the received print job is the duplex print job based on the acquired print-job-attribute information (S102). If the received print job is not the duplex print job but the one side print job (S102: NO), the one side printing is performed (S111).

If the received print job is the duplex print job (S102: YES), the number of sheets N to be successively printed on the first sides is determined (S103).

Figure 8:
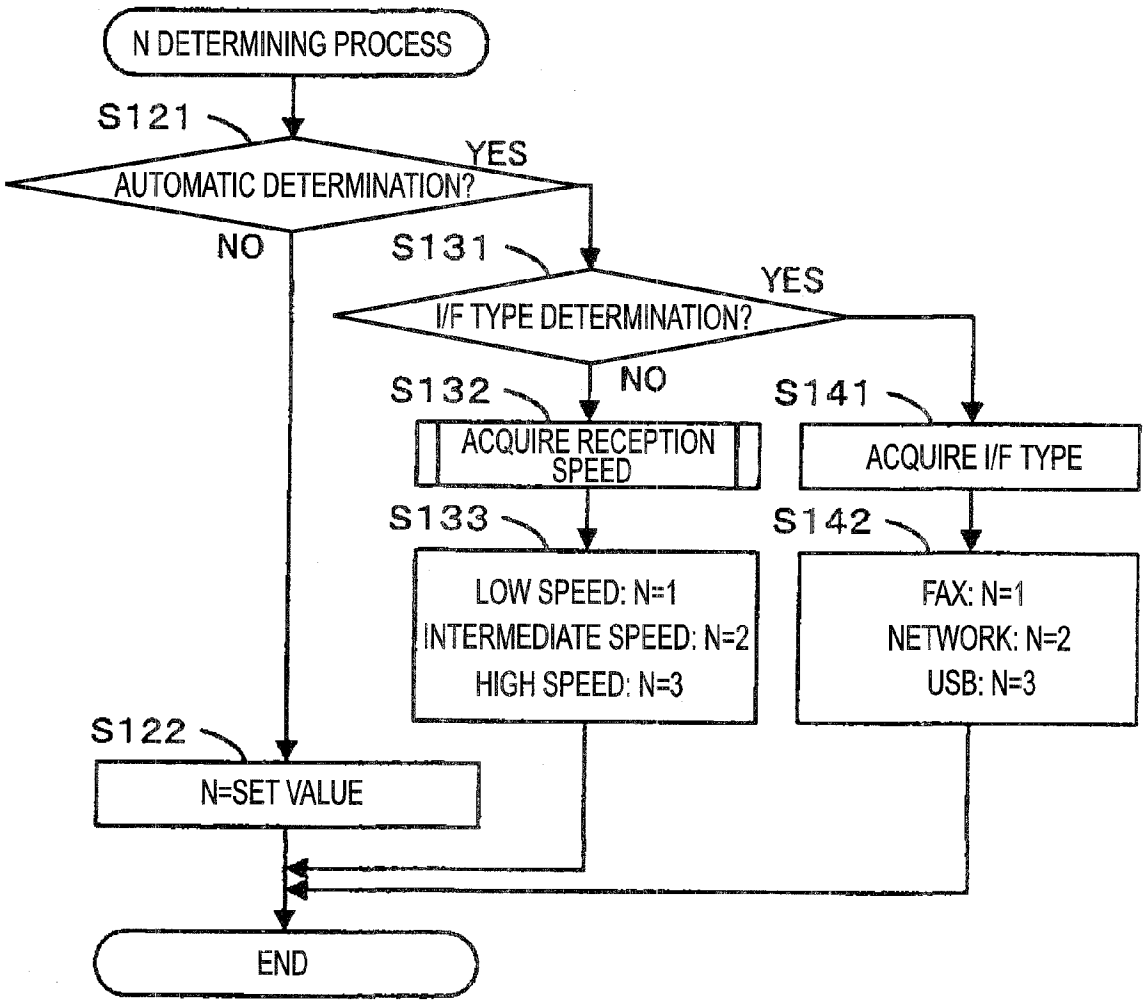
FIG. 8 is a flowchart illustrating a procedure of an N determining process.

Herein, the procedure for determining N in step S103 will be described with reference to the flowchart of FIG. 8. First, it is determined whether an automatic determination mode for determining N is set (S121). The printer 100 has an automatic determination mode for allowing the printer 100 to automatically determine a value of N in accordance with the communication speed, and a manual determination mode for determine a value of N by allowing a user to set a value for N in advance and reading the value as N. The set contents indicating the modes are stored in the storage section (the ROM 32 or the NVRAM 34) of the printer 100. If the automatic determination mode is not set, that is, the manual determination mode is set (S121: NO), the value set by a user is determined as the value of N (S122).

If the automatic determination mode is set (S121: YES), it is determined whether communication interface type is used in determining N (S131). The setting as to whether the communication interface type is used is stored in advance in the storage section of the printer 100.

If the communication interface type is used in determining N (S131: YES), the type of the communication interface through which the print data is acquired (S141). In this illustrative embodiment, as described above, the printer 100 includes, as a communication interface, the network interface 36, the FAX interface 37, and the USB interface 38. In the operation S141, the type of the communication interface currently performing communication is acquired.

Next, in accordance with the acquired communication interface type, the value of N is determined (S142). As the communication speed is slower, the smaller value is determined as the value of N. In this illustrative embodiment, the FAX interface 37 has the slowest communication speed among the three communication interfaces 36, 37, and 38, and causes the smallest value of 1 to be determined as the value of N. The USB interface 38 has the fastest communication speed, and causes the largest value of 3 to be determined as the value N. The network interface 36 has a communication speed faster than the FAX interface 37 and slower than the USB interface 38, and causes an intermediate value of 2 to be determined as the value of N.

If the communication interface type is not used in determining N (S131: NO), the value of N is determined based on the actual communication speed. Therefore, a level of the reception speed of the current print data is acquired (S132).

Figure 9:
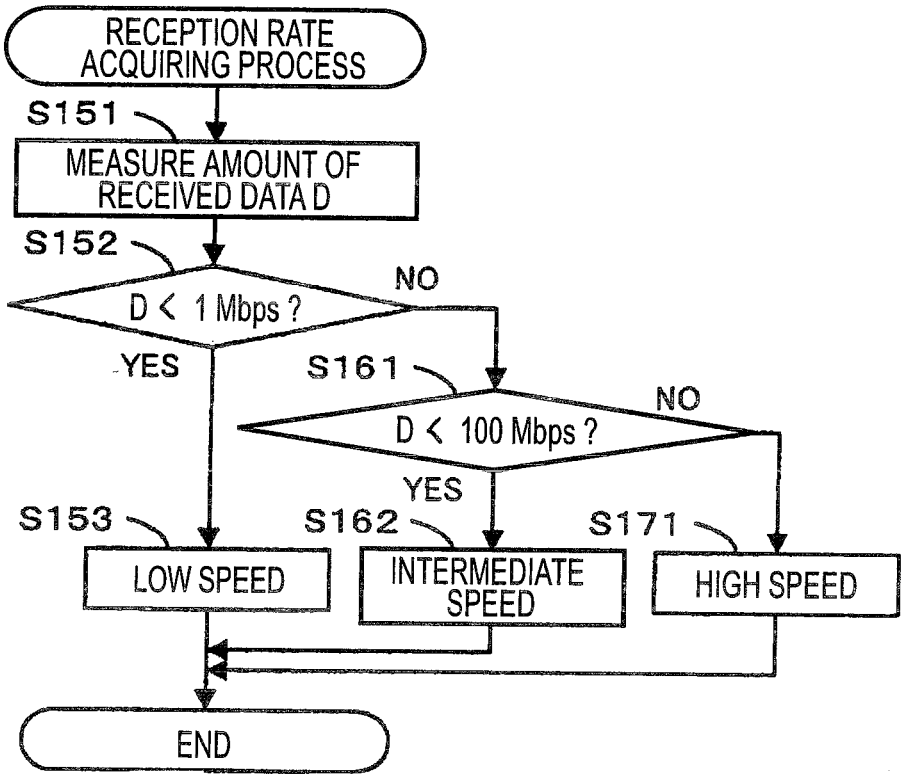
FIG. 9 is a flowchart illustrating a procedure of a reception speed acquiring process.

FIG. 9 shows the procedure of the reception speed acquiring process in the operation S132. First, the amount of received data D per unit time is measured (S151). Then, if the amount of received data D is smaller than 1 Mbps (S152: YES), the level of the reception speed is determined as a low speed (S153). If the amount of received data D is equal to or greater than 1 Mbps (S152: NO) and smaller than 100 Mbps (S161: YES), the level of the reception speed is determined as an intermediate speed (S162). If the amount of received data D is greater than 100 Mbps (S161: NO), the level of the reception speed is determined as a high speed (S171).

Then, in accordance with the level of the reception speed acquired in step S132, the value of N is determined (S133). As the level of the reception speed is lower, the smaller value is determined as the value of N. In the illustrative embodiment, 1 is set as the value of N at the low speed, 2 is set as the value of N at the intermediate speed, and 3 is set as the value of N at the high speed.

Figure 7:
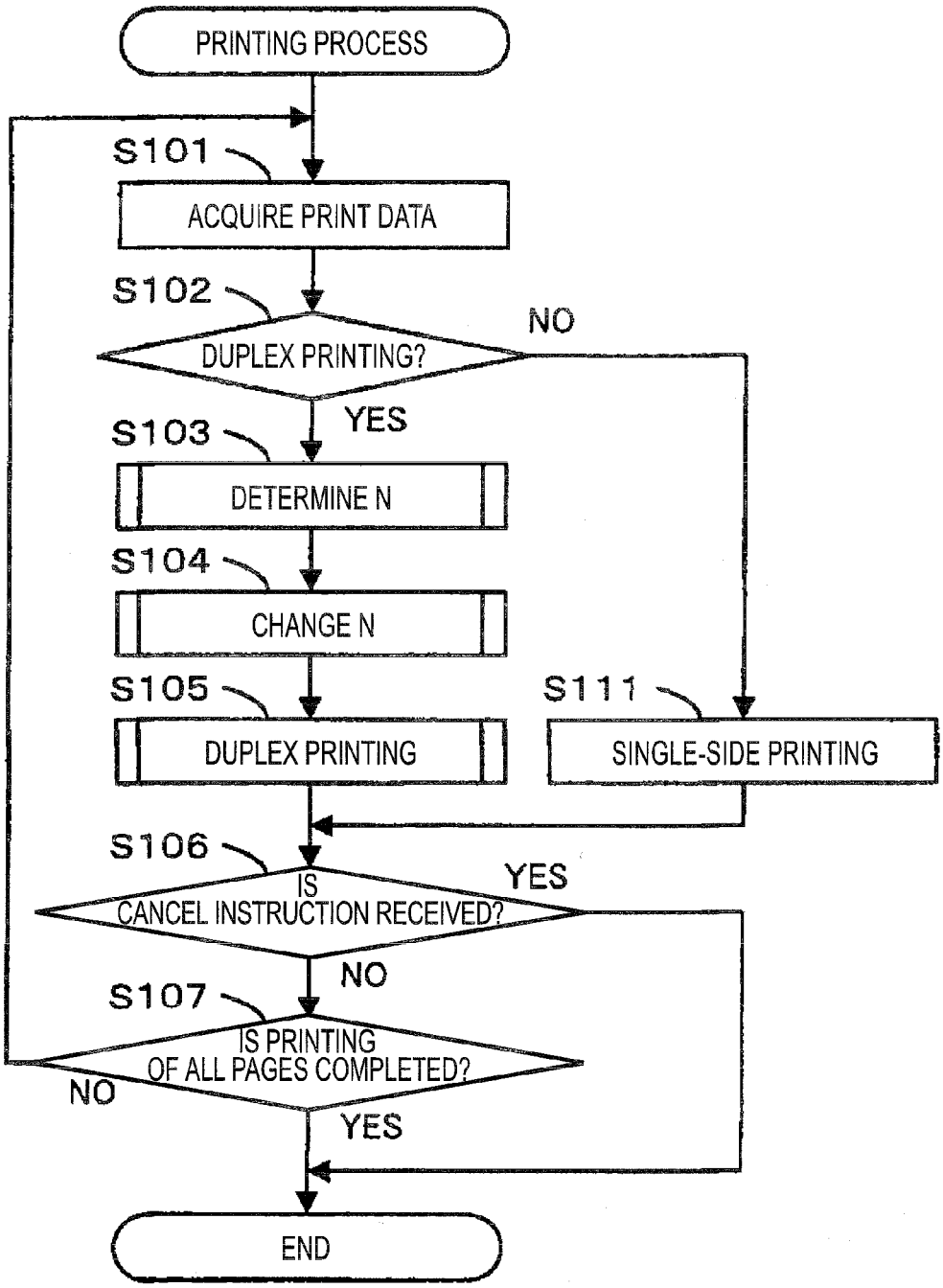
FIG. 7 is a flowchart illustrating a procedure of a printing process.

Returning to the description of FIG. 7, after the value of N is determined in the operation S103, the change of the value of N based on a condition other than the communication speed is performed as necessary (S104). The printer 100 is capable of setting a custom condition for determining the value of N based on a condition other than the communication speed. Therefore, when a user sets a custom condition and the condition is satisfied, the value of N is changed to be suitable for the condition. The custom condition will be explained in the N changing process to be described later.

Figure 10:
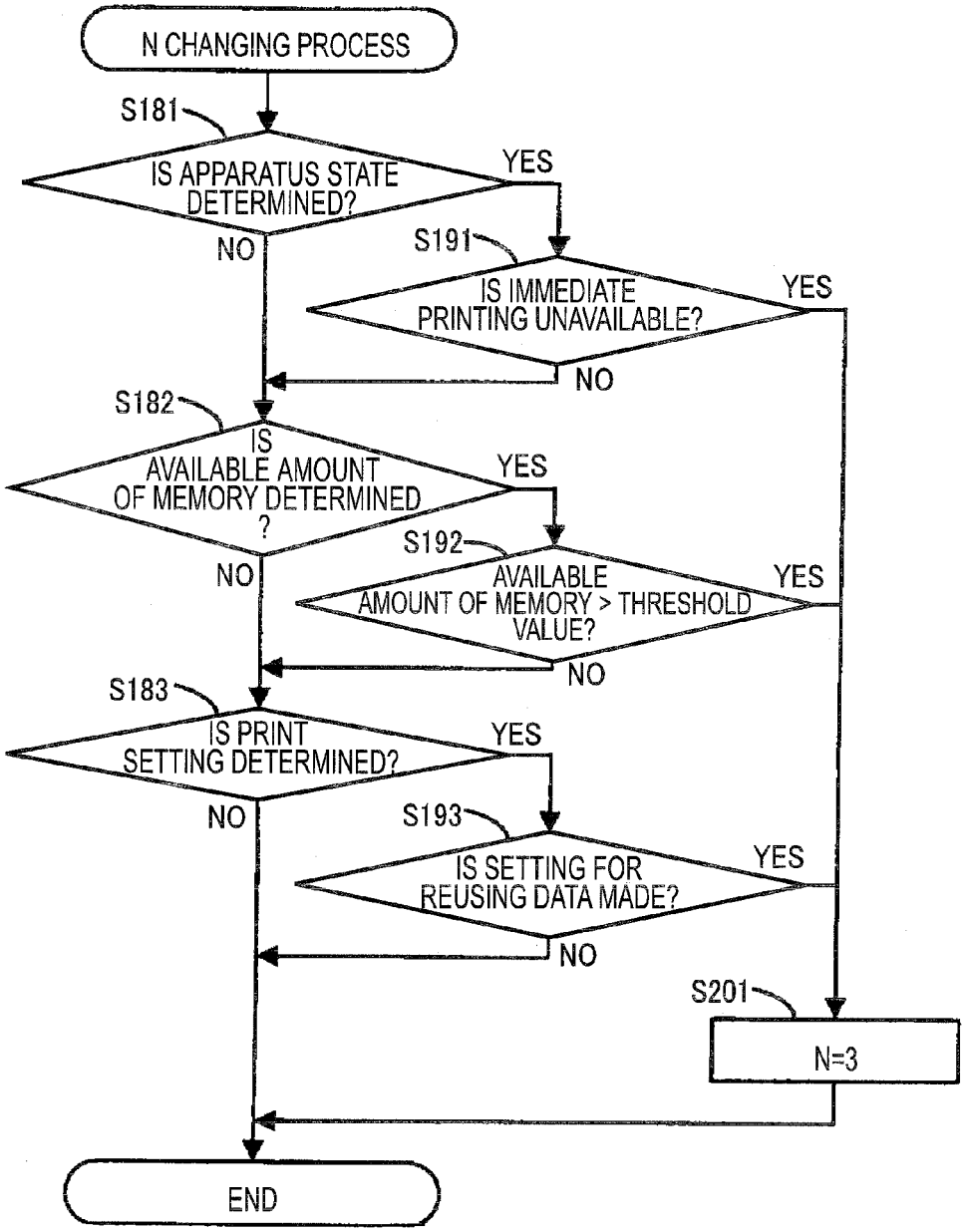
FIG. 10 is a flowchart illustrating a procedure of an N changing process.

FIG. 10 shows the procedure of the N changing process in the operation S104. First, as a custom condition, it is determined whether the setting for determining N based on an operation state, for example printing or not printing, of the printer 100 is made (S181). If it is set that the determination based on the operation state is performed (S181: YES), the printer 100 determines whether received print data can be immediately printed (a state where immediate printing of the received print data is available or unavailable) (S191). The state where immediate printing is unavailable corresponds to, for example, the case where, when second print data is received through a second interface but cannot be immediately printed, because the printer 100 is busy printing first print data through a first interface. Then, if immediate printing of the second print data is unavailable because the printer 100 is busy printing the first print data through the first interface, the printing start for the second print data is delayed until printing is available. Therefore, it is conceivable that, even though a low speed line is used for the second interface, there is time enough to complete the reception of the second print data before start printing of the second print data. Therefore, even when the value of N is set to be large, reception waiting for the second print data is less likely to occur. Accordingly, if immediate printing of the second print data is unavailable (S191: YES), the value of N is changed into 3 (S201). However, if immediate printing is available (S191: NO), priority is given to the determination in the operation S103, and the value of N is not changed, since the printer otherwise would likely be waiting for completion of reception of the second print data.

Next, as a custom condition, it is determined whether the setting for determining N based on an available amount of the memory of the printer 100 is made (S182). If it is set that the determination based on the available amount of the memory is made (S182: YES), the available amount of the memory of the printer 100 is acquired, and it is determined whether the available amount of the memory is larger than a threshold value (S192). If the available amount of the memory is larger, it is possible to use a large amount of memory by setting a value of N to be large. Accordingly, if the available amount of the memory is larger (S192: YES), the value of N is changed into 3 (S201). If the available amount of the memory is smaller (S192: NO), priority is given to the determination in the operation S103, and the value of N is not changed.

Next, as a custom condition, it is determined whether the setting for determining N based on the print setting of the printer 100 is made (S182). If it is set that the determination based on the print setting is performed (S183: YES), the print setting of the print job is acquired, and it is determined whether the setting for reusing data is made (S193). The setting of reusing data is a setting for reusing print data without deleting the print data even after the completion of the duplex printing performed on one sheet. The setting of reusing data corresponds to, for example, a sort printing setting or a reprinting setting. That is, when the setting of reusing data is made, the print data is not immediately deleted from the memory even after the end of the printing. Therefore, even if the value of N is set to be small, an effect of avoiding the disadvantage caused by the large value of N is not achieved. That is, an effect of reducing the amount of the memory used is not achieved. Accordingly, if the setting for reusing data is made (S193: YES), the value of N is changed into 3 (S201). If the setting for reusing data is not made (S193: NO), priority is given to the determination in the operation S103, and the value of N is not changed.

Further, in the above-described N changing process, the number of sheets N to be successively printed is changed into 3, but the value of N is not limited to this value. That is, within the conveyable range of sheets, the value of N may be changed into a value larger than 3. Furthermore, in accordance with another custom condition, the value of N may be changed into a smaller value.

Figure 11:
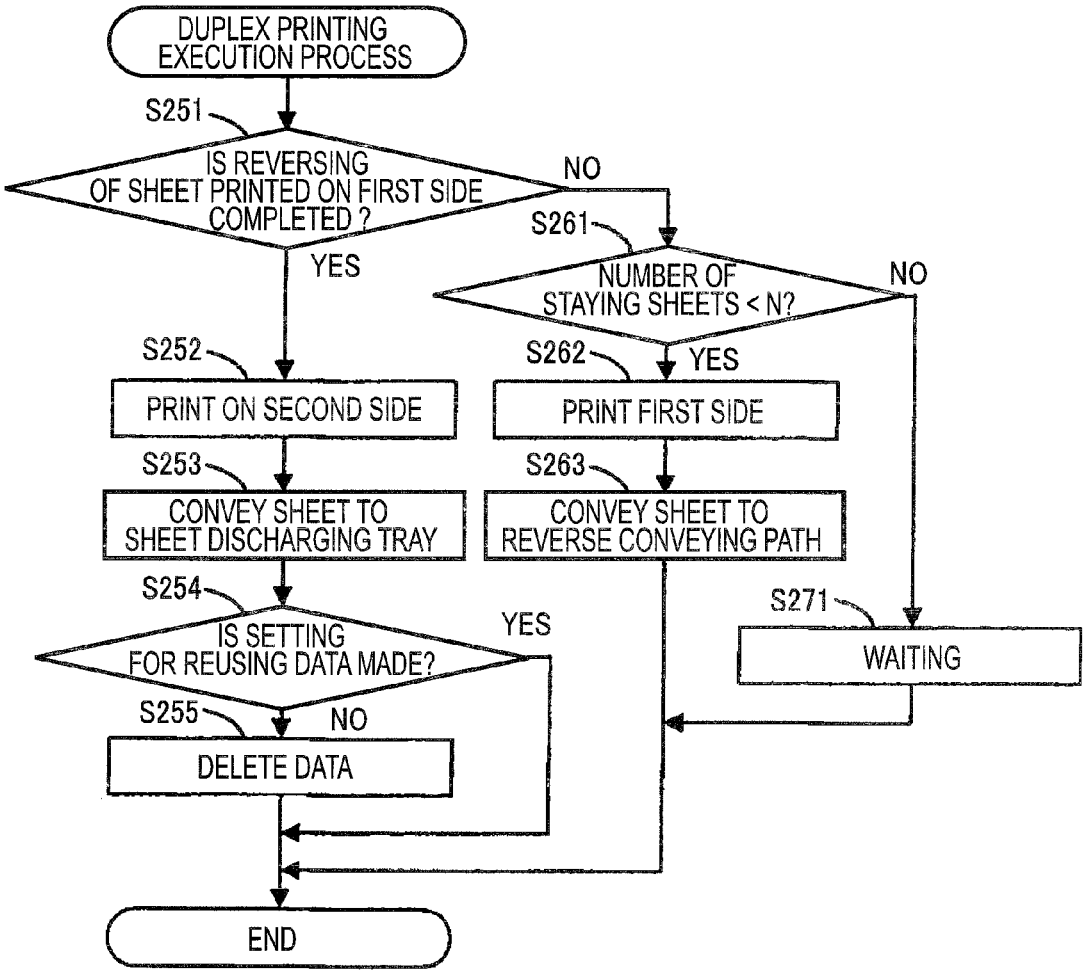
FIG. 11 is a flowchart illustrating a procedure of a duplex printing execution process.

Returning to FIG. 7, the value of N is adjusted in the operation S104, the execution of the duplex printing is started (S105). Here, the procedure of the duplex printing execution process is described with reference to the flowchart of FIG. 11. It is noted that this duplex printing execution process ends when completing single-side printing. That is, the duplex printing is performed by performing this duplex printing execution process at least twice.

First, it is determined whether the reversing of the sheet, on which the first side printing has been performed, is completed and the preparation for conveying the sheet to the processing section 50 is completed (S251). In the operation S251, it is determined that the preparation for conveying the sheet is not completed when the sheet does not stay in the reverse conveying path 12, or when the sheet is positioned at a predetermined distance or more apart from a junction position between the forward conveying path 11 and the reverse conveying path 12 even when the sheet is staying therein.

If the preparation for conveying the sheet is not completed (S251: NO), it is determined whether the number of sheets staying in the reverse conveying path 12 is smaller than N (S261). If the number of sheets is smaller than N (S261: YES), one sheet is fed from the sheet feeding cassette 91, and the sheet is conveyed to the processing section 50, thereby printing the sheet on the first side thereof (S262). Thereafter, the sheet having been printed on the first side is conveyed to the reverse conveying path 12 (S263). If the number of sheets is equal to or greater than N (S261: NO), the number of sheets staying in the reverse conveying path 12 reaches a limit thereof. Therefore, printing is suspended until the sheet in the reverse conveying path 12 is prepared to be returned to the forward conveying path 11 (S271).

If the preparation for conveying the sheet having been printed on the first side is completed (S251: YES), the sheet in the reverse conveying path 12 is conveyed to the processing section 50, and is printed on the second side thereof (S252). Thereafter, the sheet printed on both sides thereof is discharged to the sheet discharging tray 92 (S253).

Next, it is determined whether the setting for reusing the print data is made (S254). If the setting for reusing the data is made (S254: YES), the duplex printing execution process ends without deleting the print data from the memory. In contrast, if the setting for reusing the data is not made (S254: NO), the deletable print data is deleted from the memory (S255). That is, when the print data of the sheet having been printed on both sides thereof remains, the data is deleted. Furthermore, after being deleted, print data of a new page is expanded in the memory. That is, the print data of the sheet having been printed on both sides thereof is deleted immediately after printing (in response to completing the printing on both sides), thereby avoiding an increase in memory area used for the print data and suppressing a decrease in memory area usable for another process.

Returning to the printing process of FIG. 7, it is determined whether a cancel instruction is received in the print job process after the duplex printing execution process of the operation S105 (S106). If the cancel instruction is received (S106: YES), the printing process ends. The cancel instruction may be checked in the printing process. Thereby, for example, a user checks a states of an initial output of several pages, determines that the output is delayed (N is small), and has an opportunity to cancel the subsequent printing.

If the cancel instruction is not received (S106: NO), it is determined whether the printing of the all pages is completed (S107). If an unprinted page exists (S107: NO), the process returns to the operation S101, and the next page is printed. At the time of printing the next page, the communication speed is determined again, and the number of sheets N to be successively printed is changed as necessary. Accordingly, the value of N is updated even in executing the process of the same print job, so that the control operation corresponding to the actual communication speed is performed. If the printing of all pages is completed (S107: YES), the process ends.

As described above, the printer 100 according to this illustrative embodiment is capable of performing the duplex printing including printing N sheets on first sides thereof and subsequently printing M sheets (M≤N) on second sides thereof, and is also capable of changing the value of N. In addition, in determining (setting) the value of N, as the communication speed of the print data is slower (that is, it is expected that the time required for the printer 100 to receive the print data is longer), the value of N is set to be smaller, in order to perform the duplex printing. Accordingly, it can be expected to avoid the temporary suspension of the printing operation due to the waiting for receiving the print data, and it is possible to start printing early by using the print data in which the print preparation is completed. In addition, when the conveyance of the sheet is suspended because of the temporary suspension at a large value of N, a risk of disadvantages (the amount of the memory used increases, the number of sheets having print failure caused by paper jam increases, and the like) caused by a large value of N is accompanied. However, if the value of N is set to be small, it is possible to avoid such disadvantages. On the other hand, when the communication speed is high (that is, it is expected that it takes less time to receive the print data), the duplex printing is performed with a large value of N. Accordingly, it is possible to perform printing efficiently. As described above, in the illustrative embodiment, the time required for completing the printing preparation is determined based on the communication speed, and the number of sheets to be printed successively (that is, the number of sheets staying in the reverse conveying path) is changed. Therefore, it is possible to perform printing efficiently while reducing the possibility of the temporary suspension of the printing operation due to the reception waiting of the print data.

While the present invention has been shown and described with reference to certain illustrative embodiments thereof, it will be understood by those skilled in the art that various changes in form and details may be made therein without departing from the spirit and scope of the invention as defined by the appended claims.

For example, the present invention is not limited to the color printer, and may be applied to a multi function peripheral, a FAX device, and the like if it has the image forming function. Furthermore, the image formation method of the image forming section is not limited to the electrophotographic method, and may be an inkjet method. In addition, the image forming section may form a color image, or form only a monochrome image.

Further, in the above-described illustrative embodiment, a plurality of sheets are successively printed on first sides thereof, and subsequently the same number of sheets are printed on the second sides thereof. However, after the plurality of sheets are printed on the first sides thereof, printing may be performed alternately on the second sides and on the first sides. For example, when the number of sheets to be successively printed is 2, the first sheet is printed on the second side thereof (step S3), the first sheet is discharged to the sheet discharging tray 92, and the third sheet S3 is conveyed into the forward conveying path 11, and is printed on the first side (step S4'). At this time, the second sheet S2 is staying in the reverse conveying path 12, and is not returned to the forward conveying path 11. Thereafter, the sheet S3 is conveyed into the reverse conveying path 12, and the second sheet S2 is returned to the forward conveying path 11, and is printed on the second side (step S5). Then, steps S4' and S5 are repeated. For example, in a case where four sheets are printed on both sides, the printing is performed in order of the first side of the first sheet, the first side of the second sheet, the second side of the first sheet, the first side of the third sheet, the second side of the second sheet, the first side of the fourth sheet, the second side of the third sheet, and the second side of the fourth sheet. In this conveying order, while the sheet is reversed, another sheet is printed, so that printing efficiency can be improved.

Furthermore, the number of sheets M to be successively printed on the second sides may be equal to or less than the number of sheets N to be successively printed on the first sides. For example, at first, the three sheets may be successively printed on the first sides. Thereafter, the second side printing and the first side printing may be alternately performed by two sheets by two sheets.

Further, in the above-described illustrative embodiment, when the print data is expanded in the memory of the printer 100, each data corresponding one page is sequentially expanded in the memory. This process allows the amount of the used memory required to expand the print data in the memory to correspond to only one page, so that this process is particularly effective in the case where the memory capacity in the printer 100 is intended to be minimized, but the timing of expanding the print data is not limited thereto. For example, when the printer 100 includes a memory having a capacity capable of expanding the print data corresponding to all pages therein, the print data corresponding to all pages may be expanded at once in the memory.

Furthermore, in the above-described illustrative embodiment, the communication speed is acquired in the printer 100, and the number of sheets N to be successively printed on the first sides is determined in the duplex printing. However, the determination of the value of N may be performed by the printer driver 210 of the external device 200 that transmits the print job. For example, in the printer driver 210, the type of the communication interface is acquired, the value of N appropriate for the communication interface is determined, and the determined value of N may be added to the print job and transmitted to the printer 100. In the printer 100, the value of N is acquired from the received print job, and the conveyance is controlled in accordance with the value of N. Furthermore, for example, the printer driver 210 may acquire a data traffic on the communication (communication line), and determine the value of N appropriate for the data traffic on the communication. Then, the determined value of N may be added to the print job and transmitted to the printer 100.

The present invention provides illustrative, non-limiting embodiments as follows:

(1) An image forming apparatus comprises: an acquisition section configured to acquire print data; a printing section configured to perform a duplex printing including printing N sheets on first sides thereof and subsequently printing M sheets on second sides thereof, wherein M is equal to or smaller than N; a determination section configured to determine the value of N, wherein the determination section determines a smaller value as the value of N, as a communication speed of the print data when acquired by the acquisition section is lower; and a control section configured to control the printing section to perform the duplex printing in accordance with the value of N determined by the determination section.

The above-described image forming apparatus is configured to perform the duplex printing including printing N sheets on the first sides thereof and subsequently printing M sheets ($M \leq N$) on the second sides thereof, wherein "N" is a positive integer, and "M" is an integer equal to or more than 0 and equal to or less than N. Depending on the value of "N", the number of sheets staying in the apparatus as the standby of the printing on the second sides after the printing of the first sides is determined. The printing is configured to change the numbers of sheets N and M to be printed on their respective sides in the conveyable range. When determining the value of N, as the communication speed when acquiring the print data is slower, the smaller value is determined as the value of N.

That is, when the communication speed is slow in the process of the duplex printing, the image forming apparatus according to the illustrative embodiment performs the duplex printing by using the smaller value of N, which is the number of sheets to be successively printed on their first sides, to be small. Accordingly, it is possible to avoid the temporary suspension caused by the standby of the acquisition of the print data, and it can be expected that the printing is started early by using the acquired print data. Furthermore, it is possible to avoid the disadvantage caused when N is large. In contrast, when the communication speed is fast, the duplex printing is performed by using the larger value of N. Accordingly, printing efficiently can be improved.

(2) The above-described image forming apparatus may further comprise a memory configured to store the print data. The determination section may determine, as the value of N, a value which is larger than a value to be determined based on the communication speed when an available amount of the memory is larger than a threshold value. When the available amount of memory is large, although the print data as to the plurality of sheets is stored, the effect on other processes is small. Accordingly, it is advantageous to perform printing in a short time by using the larger value of N with stored print data.

(3) The above-described image forming apparatus may further comprise a memory configured to store a print job. The determination section may determine, as the value of N, a value which is larger than a value to be determined based on the communication speed when the memory stores at least two print jobs (a subject print job and another print job) which have not been completed. In the case where another uncompleted print job exists, printing does not start until the printing process of the other print job is completed. Accordingly, it is advantageous to perform printing in a short time by acquiring the print data during the standby of the printing.

(4) The above-described image forming apparatus may further comprise: a memory configured to store the print data; and a deleting section configured to delete, in response to completion of print on the first and second sides of one sheet, the print data corresponding to the one sheet. The completion of the printing may be completion of image formation on the sheet or completion of discharge of the sheet to the outside of the apparatus. By deleting the print data as early as possible, load on other processes can be reduced.

(5) The above-described image forming apparatus may further comprise a setting section capable of making a setting of reusing print data after completion of print of the print data. When the setting of reusing print data is made, the deleting section does not delete the print data even when the print is completed, and the determination section determines, as the value of N, a value which is larger than a value to be determined based on the communication speed. The "setting of reusing print data" includes, for example, the sort printing setting (which prints a plurality of sheets in the page order) and the reprinting setting (which reuses the print data by which printing is completed). The using of a small value of N is advantageous in, for example, reducing the amount of the memory used, but in the case of reusing the print data, the print data is not deleted, and therefore, this advantage can not be fully enjoyed. Accordingly, the larger N is used, and priority is given to an increase in printing speed.

(6) The above-described image forming apparatus may further comprise a changing section configured to change the value of N determined by the determination section during the duplex printing by the printing section. That is, by updating N in the process of the print job, it is possible to operate the apparatus more appropriately.

(7) The above-described image forming apparatus may further comprise a switching section capable of switching between an automatic mode of determining the value of N automatically based on the communication speed and a manual mode of determining the value of N based on a value input by a user. By allowing the manual setting of the value of N, the usability can be improved.

(8) The above-described image forming apparatus may further comprise a communication speed acquisition section configured to determine the communication speed based on a data traffic of a communication line used by the acquisition section. By determining the value of N based on the data traffic of actual communication, it is possible to operate the apparatus more appropriately.

(9) The above-described image forming apparatus may further comprise a communication speed acquisition section configured to determine the communication speed based on a type of a communication interface used by the acquisition section. By determining the value of N based on the communication interface, it is possible to operate the apparatus with a simpler configuration.

(10) A computer readable medium having a driver stored thereon and readable by a computer, the driver being used for an image forming apparatus configured to perform a duplex printing including printing N sheets on first sides thereof and subsequently printing M sheets on second sides thereof, wherein M is equal to or smaller than N, the driver, when executed by the computer, causing the computer to perform operations comprises: transmitting print data to the image forming apparatus; determining the value of N, wherein a smaller value is determined as the value of N, as a transmission speed of the print data is lower; and transmitting a print job of duplex printing including information indicating the determined value of N, to the image forming apparatus.

What is claimed is:

1. An image forming apparatus comprising:

a first receiving section configured to receive first print data;

a second receiving section configured to receive second print data;

a printing section configured to perform a duplex printing including printing N sheets on first sides thereof and subsequently printing M sheets on second sides thereof, wherein M is equal to or smaller than N;

a processor; and memory including instructions which, when executed by the processor, cause the processor to perform:

determining a value of N for performing a duplex printing of the second print data as a first value when the second print data is received via the second receiving section while the printing section is not performing printing, and determining the value of N for performing a duplex printing of the second print data as a second value, which is larger than the first value, when the second print data is received via the second receiving section while the printing section is performing printing of the first print data received via the first receiving section.

2. The image forming apparatus according to claim 1, wherein the value of N is determined to be a value which is larger than a value to be determined based on communication speed when an available amount of the memory is larger than a threshold value.

3. The image forming apparatus according to claim 1, wherein the instructions, when executed by the processor, cause the processor to further perform:

changing the value of N determined during the duplex printing by the printing section.

4. The image forming apparatus according to claim 1, wherein the instructions, when executed by the processor, cause the processor to further perform:

switching between an automatic mode of determining the value of N automatically based on communication speed and a manual mode of determining the value of N based on a value input by a user.

5. The image forming apparatus according to claim 1, wherein the instructions, when executed by the processor, cause the processor to further perform:

determining communication speed based on a data traffic of a communication line used by the second receiving section.

6. The image forming apparatus according to claim 1, wherein the instructions, when executed by the processor, cause the processor to further perform:

determining communication speed based on a type of communication interface used by the second receiving section, wherein the type of communication interface comprises one or more of network interface, fax interface, and USB interface.

7. The image forming apparatus according to claim 1, wherein the second receiving section is configured to acquire the print data using a type of communication interface having a communication speed.

8. A computer readable storage device having a driver stored thereon and readable by a computer including a first receiving section and a second receiving section, the driver being used for an image forming apparatus configured to perform a duplex printing including printing N sheets on first sides thereof and subsequently printing M sheets on second sides thereof, wherein M is equal to or smaller than N, the driver, when executed by the computer, causing the computer to perform operations comprising:

receiving first print data via the first receiving section and second print data via the second receiving section;

determining a value of N for performing a duplex printing of the second print data as a first value when the second print data is received via the second receiving section while the image forming apparatus is not performing printing, and determining the value of N for performing a duplex printing of the second print data as a second value, which is larger than the first value, when the second print data is received via the second receiving section while the image forming apparatus is performing printing of the first print data received via the first receiving section.

* * * * *